US007352135B2

(12) United States Patent
Shiotsu et al.

(10) Patent No.: US 7,352,135 B2
(45) Date of Patent: Apr. 1, 2008

(54) LIGHTING CONTROLLER FOR LIGHTING DEVICE FOR VEHICLE

(75) Inventors: Fuminori Shiotsu, Shizuoka (JP); Masayasu Ito, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 11/593,375

(22) Filed: Nov. 6, 2006

(65) Prior Publication Data

US 2007/0103098 A1 May 10, 2007

(30) Foreign Application Priority Data

Nov. 4, 2005 (JP) ..... 2005-321269

(51) Int. Cl.
*H05B 41/16* (2006.01)

(52) U.S. Cl. ..... 315/247; 315/291; 315/309; 315/224; 315/312

(58) Field of Classification Search ..... 315/247, 315/291, 307–309, 246, 224, 225, 312, 324, 315/274–278
See application file for complete search history.

(56) References Cited

U.S. PATENT DOCUMENTS 6,784,622 B2 * 8/2004 Newman et al. ..... 315/219

FOREIGN PATENT DOCUMENTS

JP 2004-51014 2/2004

* cited by examiner

*Primary Examiner*—Tuyet Vo
(74) *Attorney, Agent, or Firm*—Osha Liang LLP

(57) ABSTRACT

A lighting controller for a lighting device for a vehicle includes a semiconductor light source; a power source for supplying electric power; and control circuitry for controlling a supply of a current to the semiconductor light source. The control circuitry selectively supplies the current to the semiconductor light source through a resistance element or through a bypass circuit for bypassing the resistance element based on a determination of a state of the current. A method for controlling a lighting device for a vehicle includes receiving electric power from a power source; supplying a current to a semiconductor light source; determining a state of the current supplied to the semiconductor light source; and selectively supplying the current to the semiconductor light source through a resistance element or through a bypass circuit for bypassing the resistance element based on the determination of the state of the current.

19 Claims, 5 Drawing Sheets

FIG. 3 (a)
FIG. 3 (b)
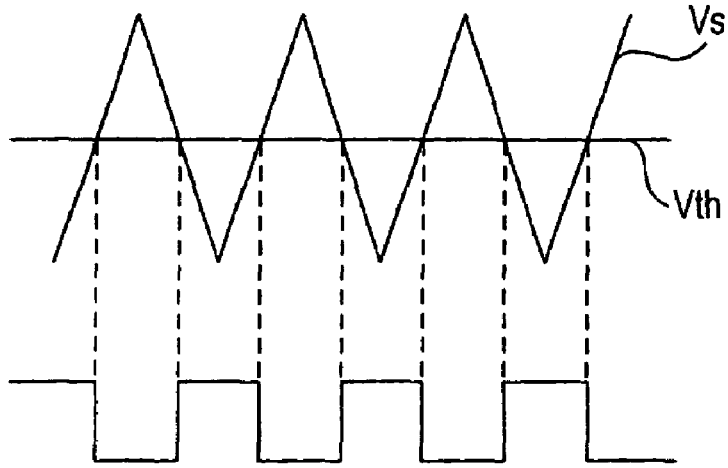
FIG. 3 (c)
FIG. 3 (d)
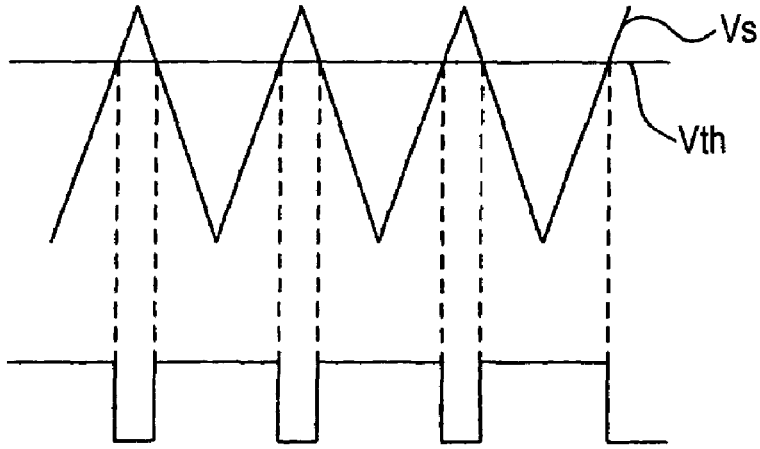
FIG. 3 (e)
FIG. 3 (f)
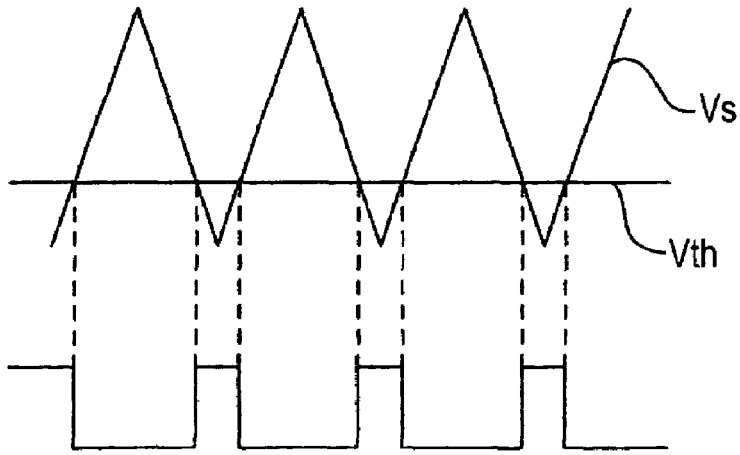

LIGHTING CONTROLLER FOR LIGHTING DEVICE FOR VEHICLE

BACKGROUND OF INVENTION

1. Field of the Invention

The present invention relates to a lighting controller for a lighting device for a vehicle, and more particularly to a lighting controller for a lighting device for a vehicle constructed so as to control a semiconductor light source composed of a semiconductor light emitting element to be turned on.

2. Background Art

As the lighting device for a vehicle, a lighting device for a vehicle using a semiconductor light emitting element such as an LED (Light Emitting Diode) as a light source has been known. Mounted on such a lighting device for a vehicle is a lighting control circuit for controlling the LED to be turned on.

As the lighting control circuit, for instance, a lighting control circuit has been proposed in which the battery voltage of a vehicle is boosted and the boosted voltage is applied to LEDs to drive a light source having a plurality of LEDs connected in series (see Patent Document 1).

In such a lighting control circuit, a structure is employed in which a voltage not higher than the forward voltage (a voltage drop) of the LED is applied to the LED to supply a prescribed current to the LED. Thus, when a supply voltage is constant, a prescribed electric current can be always supplied to the LED.

However, during a transient time, for instance, at the time of starting by turning on a power switch, when the lighting control circuit performs a control for allowing a supply current to the LED to come close to a set value, if a control delay arises, the supply current to the LED exceeds the set value to overshoot so that an over-current may be supplied to the LED. Further, when a load suddenly changes, for instance, when a chattering phenomenon arises that, when a lead wire for connecting the lighting control circuit to the LED is disconnected from a contactor and then connected to the contactor again, because the load is open and accordingly a detected current is zero, the lighting control circuit carries out a control for increasing an output voltage as much as possible to maintain the detected current to the set value. When the output voltage of the lighting control circuit reaches a maximum value, if the LED as the load is connected to the lighting control circuit, the over-current may be possibly supplied to the LED. When the over-current is supplied to the LED, a bonding wire is disconnected or a chip is deteriorated due to a current concentration. Thus, the LED fails.

[Patent Document 1] JP-A-2004-51014.

To prevent the over-current from being supplied to the LED during the transient time, a method may be devised that a resistance element is inserted into a circuit for connecting the lighting control circuit to the LED to consume the current supplied during the transient time by the resistance element and prevent the over-current from being supplied to the LED. However, in this method, because the current is consumed by the resistance element even in a steady state, a power loss is increased.

SUMMARY OF INVENTION

One or more embodiments of the present invention suppress a current supplied to a semiconductor light source during a transient time and suppress a power loss during a steady state.

In one or more embodiments, a lighting controller for a lighting device for a vehicle comprises: a current supply control unit for receiving the supply of an electric power from a power source and controlling the supply of a current to a semiconductor light source; a current detecting unit for detecting the current of the semiconductor light source; a resistance element that consumes the current when the semiconductor light source is turned on; a switch unit for forming a turning on circuit including the resistance element in a current supply path for connecting the current supply control unit to the semiconductor light source during an off operation and forming a bypass circuit for bypassing the resistance element in the current supply path during an on operation; and a switch control unit for deciding whether or not the detected current of the current detecting unit is a current showing a transient state and turning off the switch unit when an affirmative decided result is obtained, and turning on the switch unit when a negative decided result is obtained.

When a power is turned on, during a process that the current is supplied to the semiconductor light source from the current supply control unit, it is decided whether or not the current supplied to the semiconductor light source is a current showing a transient state. When the affirmative decided result is obtained, that is, the current supplied to the semiconductor light source is the current showing the transient state, the switch unit is turned off, the turning on circuit including the resistance element is formed in the current supply path for connecting the current supply control unit to the semiconductor light source and the current is consumed by the resistance element. Thus, during a transient time, an over-current can be restrained from being supplied to the semiconductor light source. On the other hand, when the turning on circuit including the resistance element is formed in the current supply path for connecting the semiconductor light source to the current supply control unit, if it is decided that the current of the semiconductor light source is not the current showing the transient state, the transient state is decided to shift to a steady state. Then, the switch unit is turned on, the bypass circuit for by-passing the resistance element is formed in the current supply path for connecting the current supply control unit to the semiconductor light source. Thus, the current can be supplied to the semiconductor light source from the current supply control unit without consuming the current in the resistance element and a power loss during the steady state can be suppressed.

In one or more embodiments, before the detected current of the current detecting unit begins to flow or when the detected current of the current detecting unit shows the transient state accompanied by an over-current, the switch control unit turns off the switch unit, and when the detected current of the current detecting unit is a current showing a steady state, the switch control unit turns on the switch unit in the lighting controller for a lighting device for a vehicle.

Before the current of the semiconductor light source begins to flow or when the current of the semiconductor light source shows the transient state accompanied by an over-current, the switch unit is turned off so that the over-current can be restrained from being supplied to the semiconductor light source during the transient time. Further, when the current of the semiconductor light source is a current showing a steady state, the switch unit is turned on so that a prescribed current is supplied to the semiconductor light source without consuming the current by the resistance element and the power loss during the steady state can be suppressed.

In one or more embodiments, when the switch control unit decides that the detected current of the current detecting unit is the current showing the steady state, then, after a setting time elapses, the switch control unit turns on the switch unit in the lighting controller for a lighting device for a vehicle.

When the current showing the steady state is supplied to the semiconductor light source, and then, the setting time elapses, the switch unit is turned on. Thus, even when the rise of the current supplied to the semiconductor light source is steep, even when the time of the transient state has a certain range, or even when a chattering phenomenon arises that a turned on state and a turned off state are continuously alternately generated, the bypass circuit is formed with a delay of the setting time, so that the over-current can be assuredly restrained from being supplied to the semiconductor light source.

In one or more embodiments, when the switch control unit decides that the detected current of the current detecting unit is the current showing the transient state, the switch control unit immediately turns on the switch unit in response to this decision in the lighting controller for a lighting device for a vehicle.

When the current of the semiconductor light source is the current showing the transient state, the switch unit is immediately tuned off. Thus, even when a chattering phenomenon arises that a turned on state and a turned off state are continuously alternately generated, the turning on circuit including the resistance element is immediately formed in the current supply path for connecting the current supply control unit to the semiconductor light source, so that the generation of the over-current can be assuredly suppressed.

In one or more embodiments, when the constant of the resistance element is set in such a way that when the current supply control unit outputs a maximum electric power during a no-load, a resistance value obtained when the current of the semiconductor light source is not higher than a maximum rated current is set as a lower limit value, and when the current supply control unit outputs a minimum electric power during a no-load, a resistance value obtained when the current of the semiconductor light source is a prescribed current is set as an upper limit value.

When the constant of the resistance element is set, if the resistance value of the resistance element is made to be too large, the current supplied to the semiconductor light source is excessively decreased. Thus, a prescribed current cannot be supplied to the semiconductor light source and the switch unit is not turned on. When the switch unit is not turned on, the current is always supplied to the resistance element and the power loss is generated. On the contrary, when the resistance value of the resistance element is too small; the current supplied to the semiconductor light source is not reduced. Thus, there is a fear that the over-current may be supplied to the semiconductor light source. Thus, for the constant of the resistance element, when the current supply control unit outputs a maximum electric power during a no-load, a resistance value obtained when the current of the semiconductor light source is not higher than a maximum rated current is set as a lower limit value, and when the current supply control unit outputs a minimum electric power during a no-load, a resistance value obtained when the current of the semiconductor light source is a prescribed current is set as an upper limit value. Accordingly, the over-current can be restrained from being supplied to the semiconductor light source during the transient state and the prescribed current can be supplied to the semiconductor light source during the steady state.

In one or more embodiments, the over-current can be restrained from being supplied to the semiconductor light source during the transient state and the power loss during the steady state can be suppressed.

In one or more embodiments, the over-current can be restrained from being supplied to the semiconductor light source during the transient state and the power loss during the steady state can be suppressed.

In one or more embodiments, the over-current can be assuredly restrained from being supplied to the semiconductor light source.

In one or more embodiments, the generation of the over-current can be assuredly suppressed.

In one or more embodiments, the over-current can be restrained from being supplied to the semiconductor light source during the transient state and the prescribed current can be supplied to the semiconductor light source during the steady state.

Other aspects and advantages of the invention will be apparent from the following description and the appended claims.

BRIEF DESCRIPTION OF DRAWINGS

FIG. 3 is a wave form diagram for explaining the operation of the control circuit.

DETAILED DESCRIPTION

Figure 1:
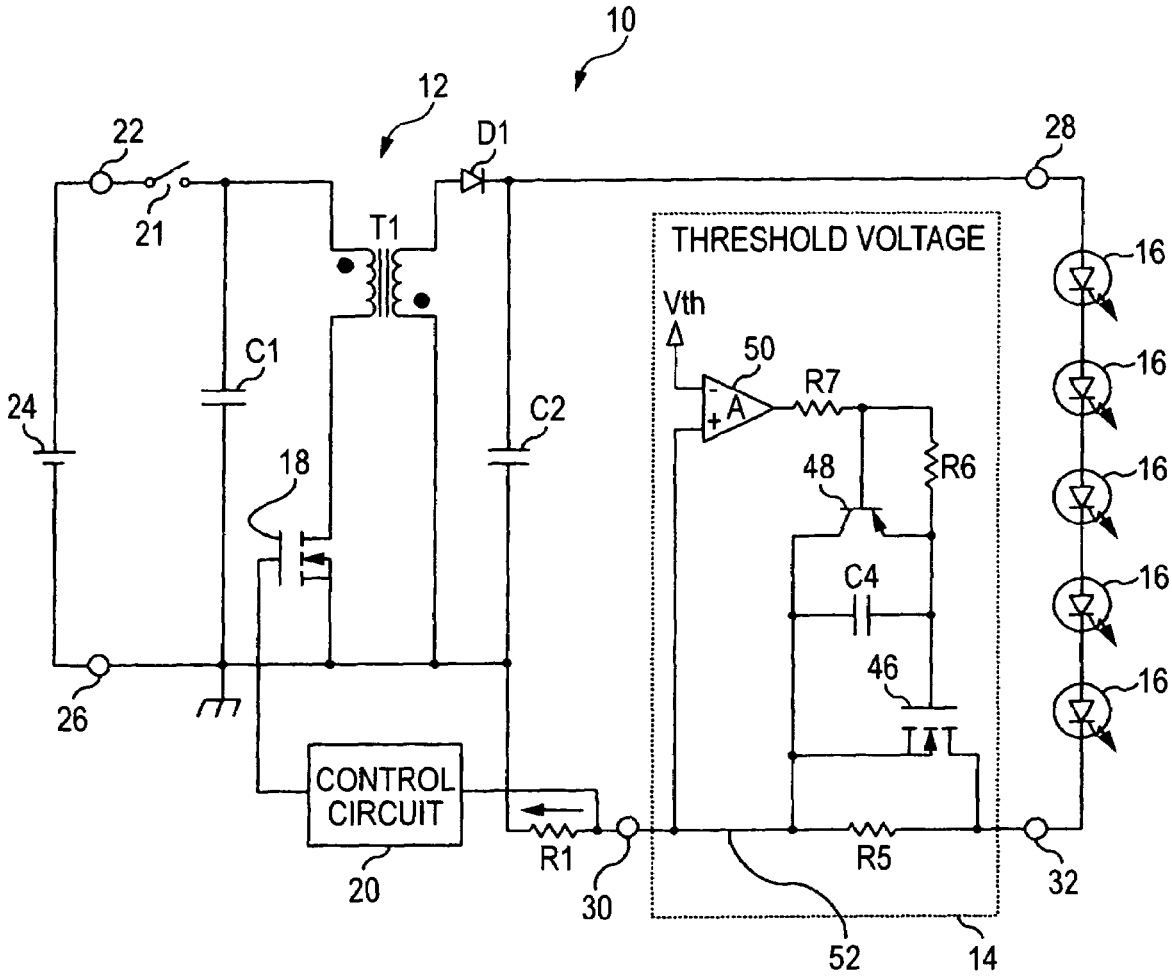
FIG. 1 is a circuit block diagram of a lighting controller for a lighting device for a vehicle showing a first embodiment of the present invention.
Figure 2:
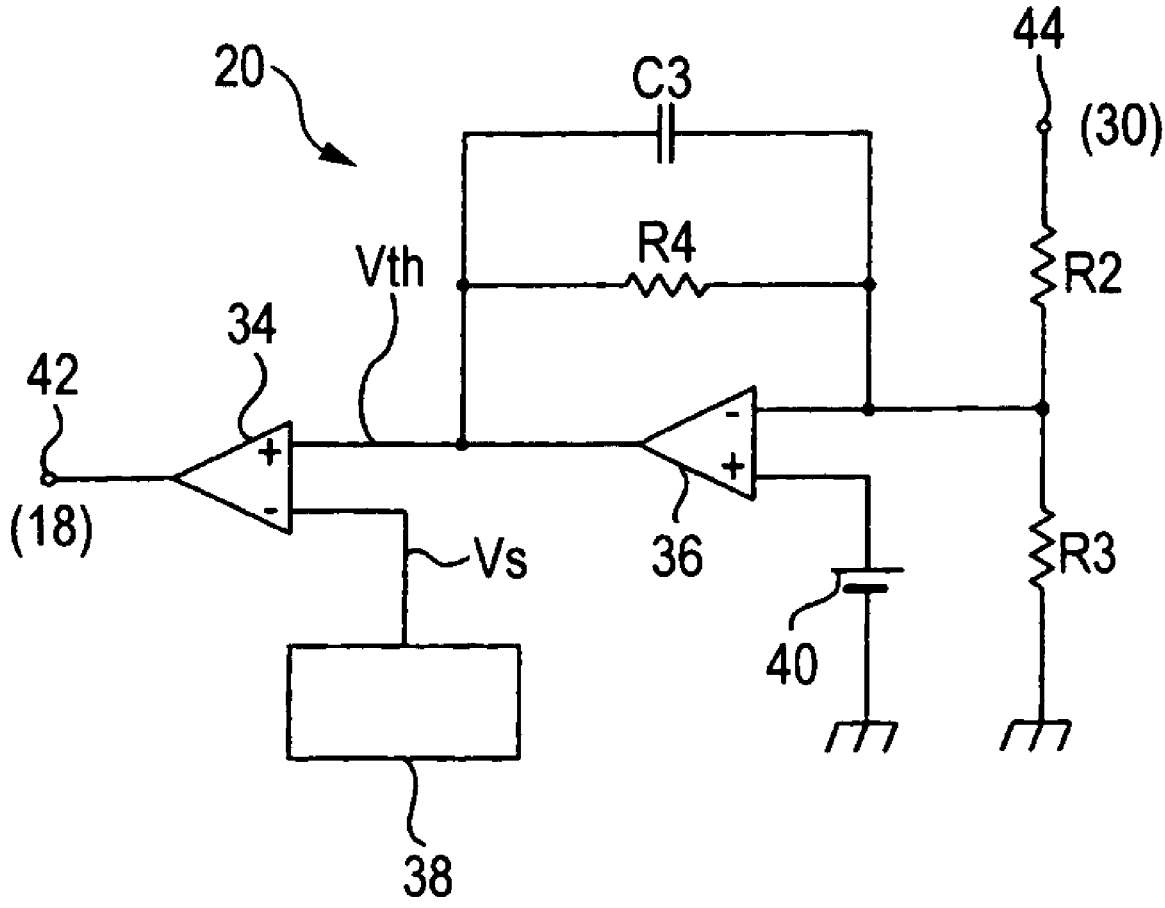
FIG. 2 is a circuit block diagram of a control circuit
Figure 4:
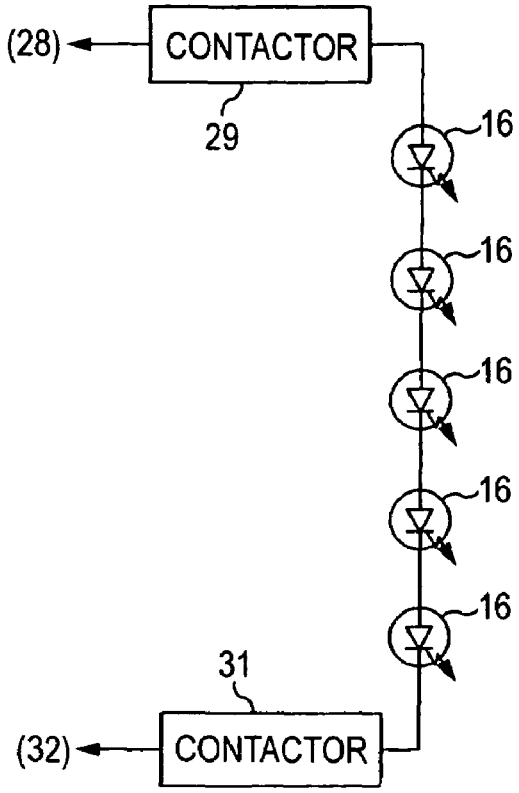
FIG. 4 is a circuit diagram showing a connecting relation between a contactor and an LED.
Figure 5:
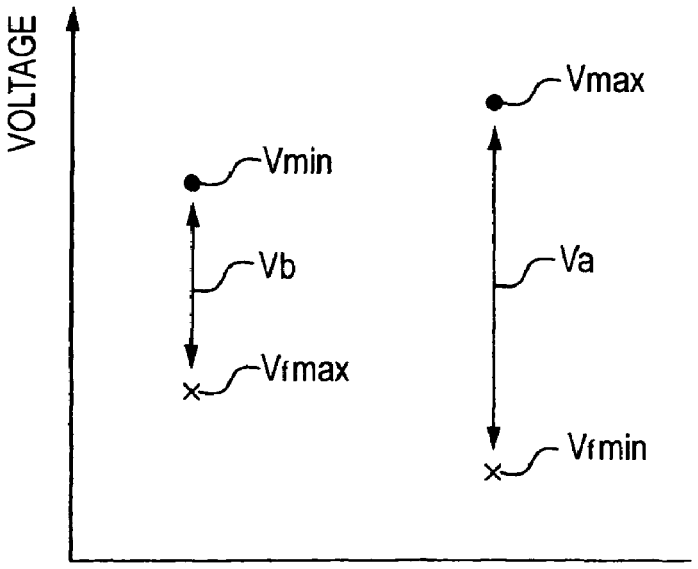
FIG. 5 is a diagram for explaining a setting method of a constant of a resistance element.
Figure 6:
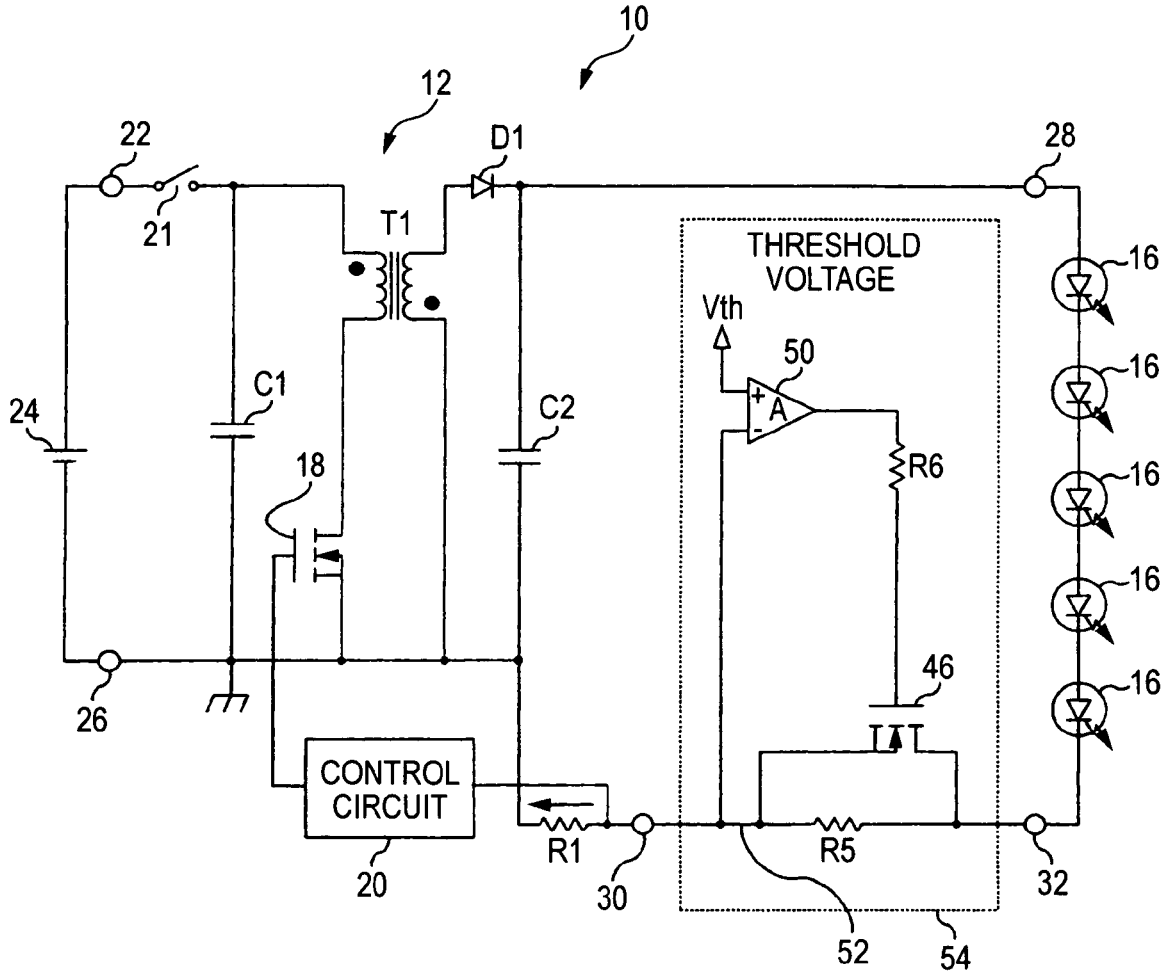
FIG. 6 is a circuit block diagram of a lighting controller for a lighting device for a vehicle showing a second embodiment of the present invention.

Now, embodiments of the present invention will be described below by referring to the drawings. FIG. 1 is a circuit block diagram of a lighting controller for a lighting device for a vehicle showing a first embodiment of the present invention. FIG. 2 is a circuit block diagram of a control circuit. FIG. 3 is a wave form diagram for explaining the operation of the control circuit. FIG. 4 is a circuit diagram showing a connecting relation between a contactor and an LED. FIG. 5 is a diagram for explaining a setting method of a constant of a resistance element. FIG. 6 is a circuit block diagram of a lighting controller for a lighting device for a vehicle showing a second embodiment of the present invention.

In these drawings, a lighting controller for a lighting device for a vehicle includes, as shown in FIG. 1, a constant current control type switching regulator 12 and a protecting circuit 14 as elements of the lighting device (a light emitting device) for a vehicle. To the switching regulator 12, a plurality of LEDs 16 as loads are connected. The LED 16 are respectively mutually connected in series and connected in parallel with the output side of the switching regulator 12 through the protecting circuit 14 as a semiconductor light source composed of semiconductor light emitting elements.

As the LED 16, one LED may be used or a plurality of LEDs 16 mutually connected in series may be used as a light source block, or the plurality of the light blocks connected in parallel may be used. Further, the LED 16 may be formed as light sources of various kinds of lighting devices for vehicles such as a head lamp, a stop and tail lamp, a fog lamp and a turn signal lamp.

The switching regulator 12 includes a transformer T1, a capacitor C1, an NMOS transistor 18, a control circuit 20, a diode D1, a capacitor C2 and a shunt resistance R1 and is formed so that a voltage not lower than the forward voltage (a voltage drop) of each LED 16 can be applied to each LED 16. The capacitor C1 is connected in parallel with a primary side of the transformer T1 and the NMOS transistor 18 is connected in series to the primary side of the transformer T1. One end side of the capacitor C1 is connected to a positive terminal of a battery 24 to be mounted on a vehicle through a power switch 21 and a power supply input terminal 22 and the other end side is connected to a negative terminal of the battery 24 to be mounted on a vehicle through a power supply input terminal 26 and grounded. The NMOS transistor 18 has a drain connected to the primary side of the transformer T1, a source grounded and a gate connected to the control circuit 20. With the secondary side of the transformer T1, the capacitor C2 is connected in parallel through the diode D1. A node of the diode D1 and the capacitor C2 is connected to an anode side of the LED 16 in the upstream side through an output terminal 28. One end side of the secondary side of the transformer T1 is grounded together with one end side of the capacitor C2 and connected to a current detecting terminal 30 through the shunt resistance R1. The current detecting terminal 30 is connected to an output terminal 32 through the protecting circuit 14. The output terminal 32 is connected to a cathode side of the LED 16 in the downstream side. The shunt resistance R1 is formed as a current detecting unit for detecting a current supplied to the LED 16. Voltage generated at both the ends of the shunt resistance R1 is fed back to the control circuit 20 as the voltage corresponding to the current of the LED 16.

The NMOS transistor 18 is formed as a switching element turned on and off in response to an on/off signal (a switching signal) outputted from the control circuit 20. When the NMOS transistor 18 is turned on, an input voltage from the battery 24 (a dc power source) to be mounted on a vehicle is accumulated in the transformer T1 as electromagnetic energy. When the NMOS transistor 18 is turned off, the electromagnetic energy accumulated in the transformer T1 is discharged to the LED 16 as light emitting energy from the secondary side of the transformer T1 through the diode D1.

That is, the switching regulator 12 is constructed as a current supply control unit for receiving the supply of an electric power from the battery 24 to be mounted on a vehicle and controlling the supply of the current to the LED 16. In this case, the switching regulator 12 compares the voltage of the current detecting terminal 30 with prescribed voltage to control an output current in accordance with the compared result.

Specifically, the control circuit 20 for controlling the output current of the switching regulator 12 includes, for instance as shown in FIG. 2, a comparator 34, an error amplifier 36, a saw tooth wave generator 38, a reference voltage 40, resistances R2, R3, and R4, and a capacitor C3. An output terminal 42 of the comparator 34 is directly connected to the gate of the NMOS transistor 18 or through a current amplifying preamplifier (not shown in the drawing). An input terminal 44 connected to one end of the resistance R2 is connected to the current detecting terminal 30. To the input terminal 44, voltage fed back from the current detecting terminal 30 is applied. The resistances R2 and R3 divide the voltage applied to the input terminal 44 to apply the voltage obtained by dividing the voltage to a negative input terminal of the error amplifier 36. The error amplifier 36 outputs voltage corresponding to the difference between the voltage applied to the negative input terminal and the reference voltage 40 to a positive input terminal of the comparator 34 as a threshold value Vth. The comparator 34 takes in a saw tooth wave Vs to a negative input terminal from the saw tooth wave generator 38 to compare the saw tooth wave Vs with the threshold value Vth and outputs an on/off signal corresponding to the result of the comparison to the gate of the NMOS transistor 18.

For instance, as shown in FIGS. 3(*a*) and 3(*b*), when the level of the threshold value Vth is located at a substantially intermediate part of the saw tooth wave Vs, the on/off signal of on duty as high as about 50% is outputted. On the other hand, when the level of the voltage fed back from the current detecting terminal 30 is lower than the reference voltage 40 as the output current of the switching regulator 12 is decreased, the level of the threshold value Vth by the output of the error amplifier 36 is high. Thus, as shown in FIGS. 3(*c*) and 3(*d*), the on/off signal of on duty higher than 50% is outputted from the comparator 34. As a result, the output current of the switching regulator 12 is increased.

On the contrary, when the level of the voltage fed back from the current detecting terminal 30 is higher than the reference voltage 402 as the output current of the switching regulator 12 is increased and the level of the threshold value Vth by the output of the error amplifier 36 is lowered, the on/off signal of on duty lower than 50% is outputted from the comparator 34, as shown in FIGS. 3(*e*) and 3(*f*). As a result, the output current of the switching regulator 12 is decreased. A chopping wave generator for generating a chopping wave (a chopping wave signal) can be used in place of the saw tooth wave generator 38.

The protecting circuit 14 includes a resistance R5 as a resistance element that consumes the current when the LED is turned on, an NMOS transistor 46, a PNP transistor 48, resistances R6 and T7 and a capacitor C4 as a switch unit and an operation amplifier 50 as a switch control unit for controlling the on-off operation of the switch unit. The control circuit 14 is inserted between the current detecting terminal 30 and the output terminal 32.

The resistance R5 is inserted into a current supply path 52 for connecting the current detecting terminal 30 to the output terminal 32. To both the ends of the resistance R5, a drain and a source of the NMOS transistor 46 are respectively connected. The operation amplifier 50 has a positive input terminal connected to the current detecting terminal 30 and a negative input terminal connected to a threshold voltage Vth to compare the voltage of the current detecting terminal 30 with the threshold voltage Vth, decides whether or not the current supplied to the LED 16 is a current showing a transient state and outputs a voltage corresponding to the decided result. Here, the transient state means a state established before the current begins to be supplied or when an over-current is supplied.

For instance, when the voltage of the current detecting terminal 30 is lower than the threshold voltage Vth, the operation amplifier 50 decides that the current of the LED 16 is the current showing the transient state and outputs the voltage of a low level as an affirmative decided result. When the voltage of the current detecting terminal 30 exceeds the threshold voltage vth, the operation amplifier 50 decides that the current of the LED 16 is a prescribed current showing a steady state and outputs the voltage of a high level as a negative decided result When the voltage of the high level is outputted from the operation amplifier 50, this voltage is applied to both the ends of the capacitor C4 through the resistances R7 and R6. The voltage at both the ends of the capacitor C4 is increased in accordance with a time constant determined by the resistances R7, R6 and the capacitor C4. Then, when the voltage at both the ends of the capacitor C4 exceeds the threshold value of the NMOS transistor 46, the NMOS transistor 46 is turned on. That is, the NMOS transistor 46 is turned on with the elapse of a set time after the voltage of the high level is outputted from the operation amplifier 50.

When the NMOS transistor 46 is turned off, a turning on circuit including the resistance R5 is formed in the current supply path 52. However, when the NMOS transistor 46 is turned on, a bypass circuit for bypassing the resistance R5 is formed in the current supply path 52.

Namely, when the current of the LED 16 is in a transient state, the current is supplied to the turning on circuit including the resistance R5 to consume the current with the resistance R5. On the other hand, when the current of the LED 16 shifts to a steady state from the transient state, the bypass circuit, in which the current is not supplied to the resistance R5, to bypass the resistance R5 is formed by the NMOS transistor 46 so that a prescribed current is supplied through the NMOS transistor 46.

When the prescribed current is supplied to the LED 16, if a chattering phenomenon arises that, when a lead wire for connecting the output terminal 28 or the output terminal 32 to the LED 16 is disconnected from contactors 29 and 31 shown in FIG. 4 and then connected again to the contactors 29 and 31 so that a period is generated during which the current is not supplied to the LED 16, the output of the operation amplifier 50 shifts to the low level from the high level. Then, the PNP transistor 48 is turned on and an electric charge accumulated in the capacitor C4 is instantaneously discharged and the NMOS transistor 46 is immediately turned off. At this time, because, as the current is not supplied to the LED 16, the control circuit 20 performs a control for increasing the output current of the switching regulator 12, the output voltage of the switching regulator 12 is suddenly elevated. In this process, when the LED 16 is connected to the switching regulator 12, a high voltage is applied to the LED 16. However, because the NMOS transistor 46 is turned off, the current of the LED 16 is supplied through the resistance R5. Accordingly, even when the chattering phenomenon arises, the over-current can be prevented from being supplied to the LED 16.

Further, the constant of the resistance R5 is set in such a way that when the switching regulator 12 outputs a maximum electric power during a no load state, a resistance value obtained when the current of the LED 16 is not higher than a maximum rated current is set as a lower limit value, and when the switching regulator 12 outputs a minimum electric power during a no load state, a resistance value obtained when the current of the LED 16 is the prescribed current is set as an upper limit value.

That is, when the resistance value of the resistance R5 is too large, the current supplied to the LED 16 is excessively decreased, so that the prescribed current is not supplied to the LED 16 and the NMOS transistor 46 is not turned on. When the NMOS transistor 46 is not turned on, the current is always supplied through the resistance R5 to generate a power loss.

On the other hand, when the resistance value R5 is too small, the current of the LED 16 is not decreased and the over-current is supplied to the LED 16. Therefore, in this embodiment, the resistance value of the resistance R5 is set to such a value as to suppress the supply of the over-current to the LED 16 during the transient state and supply the prescribed current to the LED 16 during the steady state.

Specifically, when an unevenness arises in the temperature characteristics of the resistance element such as the resistance R1 or the temperature characteristics of the reference voltage 40, a consideration is directed to a fact that an unevenness is generated in the output voltage of the switching regulator 12 during the no load state and an unevenness is generated in the forward voltage Vf of the LED 16 due to the temperature characteristics or a solid difference. Then, as shown in FIG. 5, the constant (the resistance value) of the resistance R5 is set in such a way that the current not higher than the maximum rated current is supplied to the LED 16 under a voltage difference Va between the maximum value Vmax of the output voltage of the switching regulator 12 during the no load and the minimum value Vfmin of the forward voltage Vf of the LED 16, and the current not lower than the prescribed current is supplied to the LED 16 under the voltage difference Vb between the minimum value Vmin of the output voltage of the switching regulator 12 during the no load and the maximum value Vfmax of the forward voltage Vf of the LED 16.

In the above-described structure, during the process that the power switch 21 is turned on to activate the switching regulator 12 and the current is supplied to the LED 16 from the switching regulator 12, at the time of the transient state immediately after the power is turned on, the voltage of the current detecting terminal 30 is lower than the threshold voltage Vth. Thus, the NMOS transistor 46 is kept turned off and the current of the LED 16 is supplied through the resistance R5. Therefore, when the power is turned on, even if the output voltage of the switching regulator 12 is abruptly elevated, the over-current can be prevented from being supplied to the LED 16 and the LED 16 can be prevented from failing.

After the power is turned on, the transient state shifts to the steady state and when the voltage of the current detecting terminal 30 exceeds the threshold voltage Vth, the NMOS transistor 46 is turned on to form the bypass circuit for bypassing the resistance R5 and the prescribed current is supplied to the LED 16. At this time, because the current of the LED 16 flows through the NMOS transistor 46, the power loss can be avoided during the steady state.

During the process that the prescribed current is supplied to the LED 16, when the chattering phenomenon due to the sudden change of the load, the output of the operation amplifier 50 shifts to the low level from the high level to immediately turn off the NMOS transistor 46. Accordingly, when the output voltage of the switching regulator 12 subsequently becomes a high voltage, even if the LED 16 is connected to the switch regulator 12, the current is supplied to the LED through the resistance R5, so that the over-current can be prevented from being supplied to the LED 16.

According to this embodiment, during the transient state, the turning on circuit including the resistance R5 is formed in the current supply path 52 and the current is consumed by the resistance R5. Thus, the over-current can be prevented from being supplied to the LED 16. On the other hand, during the steady state, the bypass circuit for bypassing the resistance R5 is formed in the current supply path 52 by the NMOS transistor 46 so that the current is not consumed by the resistance R5. Thus, the power loss can be suppressed.

Now, a second embodiment of the present invention will be described with reference to FIG. 6. In this embodiment, a protecting circuit 54 is provided in place of the protecting circuit 14. Other structures are the same as those shown in FIG. 1. Further, in the first embodiment, the state obtained before the current begins to be supplied or the state accompanied by the over-current is decided to be the transient state. However, in this embodiment, only the generation of an over-current is decided to be a transient state.

The protecting circuit 54 includes a resistance R5 as a resistance element that consumes a current when an LED is turned on, an NMOS transistor 46 and a resistance R6 as a switch unit, and an operation amplifier 50 as a switch control unit for controlling the on-off operation of the switch unit. The control circuit 54 is inserted between a current detecting terminal 30 and an output terminal 32.

The resistance R5 is inserted into a current supply path 52 for connecting the current detecting terminal 30 to the output terminal 32. To both the ends of the resistance R5, a drain and a source of the NMOS transistor 46 are respectively connected. The operation amplifier 50 has a negative input terminal connected to the current detecting terminal 30 and a positive input terminal connected to a threshold voltage Vth to compare the voltage of the current detecting terminal 30 with the threshold voltage Vth, determines whether or not the current supplied to the LED 16 is a current showing a transient state exceeding a prescribed range and outputs a voltage corresponding to the determined result.

For instance, when the voltage of the current detecting terminal 30 is lower than the threshold voltage Vth, the operation amplifier 50 decides that the current of the LED 16 is not the over-current showing the transient state, that is, the current not higher than the over-current and outputs the voltage of a high level as a negative decided result. When the voltage of the current detecting terminal 30 exceeds the threshold voltage Vth, the operation amplifier 50 decides that the current of the LED 16 is the over-current showing the transient state and outputs the voltage of a low level as an affirmative decided result.

When the voltage of the high level is outputted from the operation amplifier 50, the NMOS transistor 46 is turned on. When the NMOS transistor 46 is turned on, a bypass circuit for bypassing the resistance R5 is formed in the current supply path 52 for connecting the current detecting terminal 30 to the output terminal 32.

When the NMOS transistor 46 is turned on, the bypass circuit for bypassing the resistance R5 is formed in the current supply path 52. However, when the over-current is supplied to the LED 16 as the current of the LED 16 increases, the voltage of the low level is outputted from the operation amplifier 50 to turn off the NMOS transistor 46 and a turning on circuit including the resistance R5 is formed in the current supply path 52.

That is, when the current of the LED 16 is the over-current, the current is supplied through the turning on circuit including the resistance R5 and the current is consumed by the resistance R5. Thus, the LED 16 can be protected form the over-current.

According to this embodiment, when the over-current is supplied to the LED 16, because the turning on circuit including the resistance R5 is formed in the current supply circuit 52, the LED 16 can be protected from the over-current.

DESCRIPTION OF REFERENCE NUMERALS AND SIGNS

10 . . . . lighting controller for lighting device for vehicle 12 . . . switching regulator 14 . . . protecting circuit 16 . . . LED 18 . . . NMOS transistor 20 . . . control circuit 34 . . . comparator 36 . . error amplifier 38 . . . saw tooth wave generator 46 . . . NMOS transistor 48 . . PNP transistor 50 . . operation amplifier 52 . . current supply path 54 . . . protecting circuit

[FIG. 1]

20 . . . control circuit Vth . . . threshold voltage

[FIG. 4]

29, 31 . . . contactor

[FIG. 5]

a . . . voltage

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A lighting controller for a lighting device for a vehicle comprising:

a current supply control unit for receiving a supply of an electric power from a power source and controlling a supply of a current to a semiconductor light source;

a current detecting unit for detecting the current of the semiconductor light source;

a resistance element that consumes the current when the semiconductor light source is turned on;

a switch unit for forming a turning on circuit including the resistance element in a current supply path for connecting the current supply control unit to the semiconductor light source during an off operation and forming a bypass circuit for bypassing the resistance element in the current supply path during an on operation; and a switch control unit for deciding whether or not the detected current of the current detecting unit is a current showing a transient state, wherein the switch control unit turns off the switch unit when an affirmative decided result is obtained and turns on the switch unit when a negative decided result is obtained.

2. The lighting controller according to claim 1, wherein a constant of the resistance element is set in such a way that when the current supply control unit outputs a maximum electric power during a no-load state, a resistance value obtained when the current of the semiconductor light source is not higher than a maximum rated current is set as a lower limit value, and when the current supply control unit outputs a minimum electric power during a no-load state, a resistance value obtained when the current of the semiconductor light source is a prescribed current is set as an upper limit value.

3. The lighting controller according to claim 1, wherein before the detected current of the current detecting unit begins to flow or when the detected current of the current detecting unit shows the transient state, the switch control unit turns off the switch unit, and when the detected current of the current detecting unit is a current showing a steady state, the switch control unit turns on the switch unit.

4. The lighting controller according to claim 3, wherein a constant of the resistance element is set in such a way that when the current supply control unit outputs a maximum electric power during a no-load state, a resistance value obtained when the current of the semiconductor light source is not higher than a maximum rated current is set as a lower limit value, and when the current supply control unit outputs a minimum electric power during a no-load state, a resistance value obtained when the current of the semiconductor light source is a prescribed current is set as an upper limit value.

5. The lighting controller according to claim 3, wherein when the switch control unit decides that the detected current of the current detecting unit is the current showing the steady state, then, after a set time elapses, the switch control unit turns on the switch unit.

6. The lighting controller for a lighting device for a vehicle according to claim 5, wherein when the switch control unit decides that the detected current of the current detecting unit is the current showing the transient state, the switch control unit immediately turns off the switch unit.

7. The lighting controller according to claim 5, wherein a constant of the resistance element is set in such a way that when the current supply control unit outputs a maximum electric power during a no-load state, a resistance value obtained when the current of the semiconductor light source is not higher than a maximum rated current is set as a lower limit value, and when the current supply control unit outputs a minimum electric power during a no-load state, a resistance value obtained when the current of the semiconductor light source is a prescribed current is set as an upper limit value.

8. The lighting controller according to claim 3, wherein when the switch control unit decides that the detected current of the current detecting unit is the current showing the transient state, the switch control unit immediately turns off the switch unit.

9. The lighting controller according to claim 8, wherein a constant of the resistance element is set in such a way that when the current supply control unit outputs a maximum electric power during a no-load state, a resistance value obtained when the current of the semiconductor light source is not higher than a maximum rated current is set as a lower limit value, and when the current supply control unit outputs a minimum electric power during a no-load state, a resistance value obtained when the current of the semiconductor light source is a prescribed current is set as an upper limit value.

10. A lighting controller for a lighting device for a vehicle comprising:

a semiconductor light source;

a power source for supplying electric power; and control circuitry for controlling a supply of a current to the semiconductor light source;

wherein the control circuitry selectively supplies the current to the semiconductor light source through a resistance element or through a bypass circuit for bypassing the resistance element based on a determination of a state of the current.

11. The lighting controller according to claim 10, wherein a constant of the resistance element is set in such a way that when a maximum electric power is output during a no-load state, a resistance value obtained when the current of the semiconductor light source is not higher than a maximum rated current is set as a lower limit value, and when a minimum electric power is output during a no-load state, a resistance value obtained when the current of the semiconductor light source is a prescribed current is set as an upper limit value.

12. The lighting controller according to claim 10, wherein the control circuitry initially supplies the current to the semiconductor light source through the resistance element until the state of the current is determined.

13. The lighting controller according to claim 12, wherein when the control circuitry determines the state of the current to be a steady state, after a set time elapses, the control circuitry supplies the current to the semiconductor light source through the bypass circuit.

14. The lighting controller according to claim 12, wherein when the control circuitry determines a state of the current to be a transient state, the control circuitry immediately supplies the current to the semiconductor light source through the resistance element.

15. A method for controlling a lighting device for a vehicle comprising:

receiving electric power from a power source;

supplying a current to a semiconductor light source;

determining a state of the current supplied to the semiconductor light source; and selectively supplying the current to the semiconductor light source through a resistance element or through a bypass circuit for bypassing the resistance element based on the determination of the state of the current.

16. The lighting controller according to claim 15, further comprising setting a constant of the resistance element in such a way that when a maximum electric power is output during a no-load state, a resistance value obtained when the current of the semiconductor light source is not higher than a maximum rated current is set as a lower limit value, and when a minimum electric power is output during a no-load state, a resistance value obtained when the current of the semiconductor light source is a prescribed current is set as an upper limit value.

17. The method according to claim 15, further comprising initially supplying the current to the semiconductor light source through the resistance element until the state of the current is determined.

18. The method according to claim 17, further comprising, when the state of the current is determined to be a steady state, after a set time elapses, supplying the current to the semiconductor light source through the bypass circuit.

19. The lighting controller according to claim 17, further comprising, when the state of the current is determined to be a transient state, immediately supplying the current to the semiconductor light source through the resistance element.

* * * * *